US008435009B2

(12) United States Patent
Moore et al.

(10) Patent No.: US 8,435,009 B2
(45) Date of Patent: May 7, 2013

(54) SUMP PUMP WITH EMERGENCY BACKUP SYSTEM

(75) Inventors: Carl P. Moore, Macedonia, OH (US); Chad J. Bradley, Sagamore Hills, OH (US)

(73) Assignee: EverDry Marketing & Management, Inc., Macedonia, OH (US)

( * ) Notice: Subject to any disclaimer, the term of this patent is extended or adjusted under 35 U.S.C. 154(b) by 1022 days.

(21) Appl. No.: 12/372,977

(22) Filed: Feb. 18, 2009

(65) Prior Publication Data

US 2009/0208345 A1 Aug. 20, 2009

Related U.S. Application Data

(60) Provisional application No. 61/030,102, filed on Feb. 20, 2008.

(51) Int. Cl.
*F04B 41/06* (2006.01)

(52) U.S. Cl.
USPC ..... 417/6

(58) Field of Classification Search ..... 417/1–9
See application file for complete search history.

(56) References Cited

U.S. PATENT DOCUMENTS

| | | | | |
|---|---|---|---|---|
| 3,404,700 | A * | 10/1968 | Boothe | 137/805 |
| 4,087,204 | A | 5/1978 | Niedermeyer | |
| 4,222,711 | A | 9/1980 | Mayer | |
| 4,228,427 | A | 10/1980 | Niedermeyer | |
| 4,437,811 | A | 3/1984 | Iwata et al. | |
| 4,538,386 | A | 9/1985 | DiCello | |
| 4,652,802 | A | 3/1987 | Johnston | |
| 5,283,569 | A * | 2/1994 | Nelson | 340/623 |
| 5,449,274 | A | 9/1995 | Kochan, Jr. | |
| 5,503,533 | A | 4/1996 | Potter et al. | |
| 5,870,865 | A | 2/1999 | Wesolowski et al. | |
| 5,944,263 | A | 8/1999 | Lucco et al. | |
| 6,443,715 | B1 | 9/2002 | Mayleben et al. | |
| 6,462,666 | B1 | 10/2002 | Einck | |
| 6,634,144 | B1 | 10/2003 | Moore et al. | |
| 2005/0281679 | A1 | 12/2005 | Niedermeyer | |
| 2008/0031751 | A1 * | 2/2008 | Littwin et al. | 417/411 |

* cited by examiner

*Primary Examiner* — Anh Mai
*Assistant Examiner* — Hana Featherly
(74) *Attorney, Agent, or Firm* — Brennan, Manna & Diamond, LLC

(57) ABSTRACT

A flood control system for use in a structure having a basement floor below ground level is provided. The flood control system comprises a sump, a main pump positioned in the sump, and a secondary pump positioned in the sum. The secondary pump is raised relative to the main pump to a predetermined elevation. The main pump is energized when a height of water within the sump is at a first level. The secondary pump is energized when a height of water within the sump reaches a second, higher level and is de-energized when a height of water within the sump drops to a third level. A cover is releasably mounted to the sump. The cover includes a first section for covering the main pump and a separate second section for covering the secondary pump. At least one of the first and second sections is hingedly mounted to the sump. A controller is operatively connected to the main pump and the secondary pump. The controller is responsive to water level within the sump to selectively energize at least one of the main pump and the secondary pump.

19 Claims, 4 Drawing Sheets

FIGURE 5
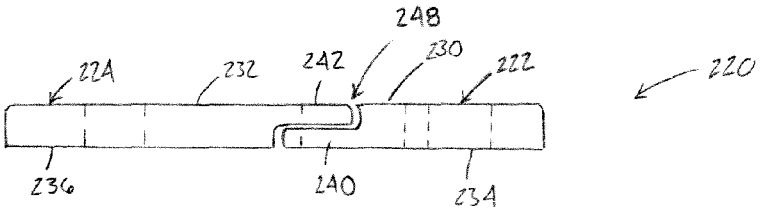
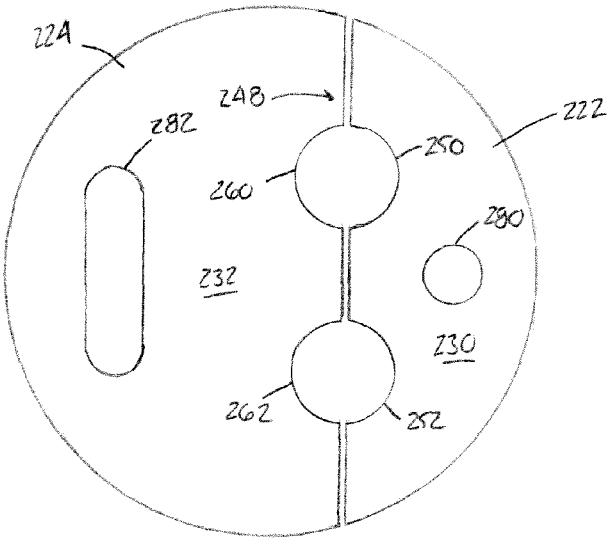
FIGURE 6
FIGURE 3
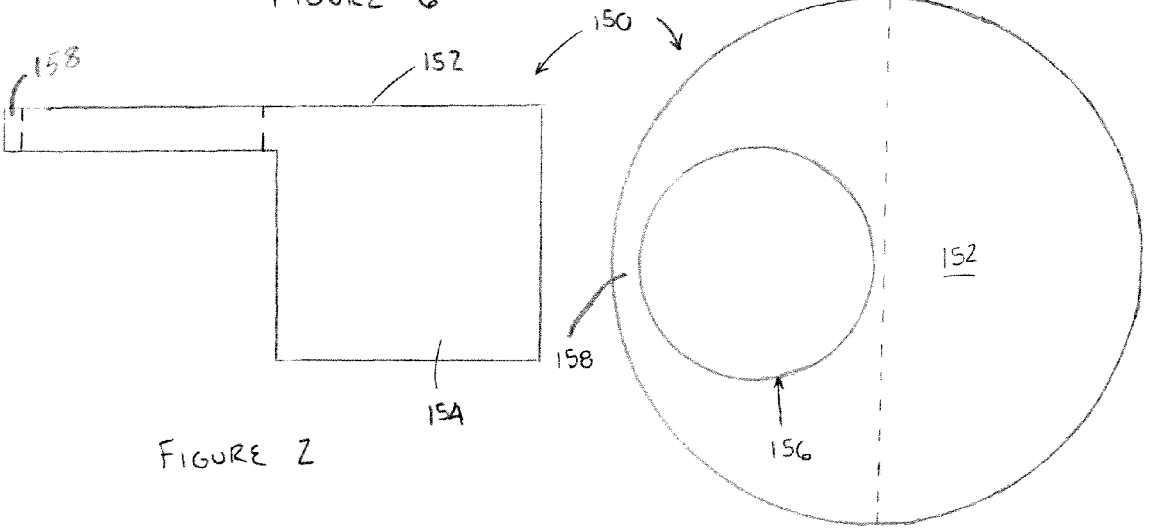
FIGURE 2

SUMP PUMP WITH EMERGENCY BACKUP SYSTEM

RELATED APPLICATIONS

This application claims priority from U.S. Provisional Patent Application Ser. No. 61/030,102, filed 20 Feb. 2008, the disclosure of which is incorporated herein by reference.

BACKGROUND

The present disclosure relates to the control of subterranean water. Particularly, the present disclosure relates to a sump pump with an emergency backup system for use in a structure having a basement floor located below ground level, which must be kept free of the ingress of subterranean water.

In structures, such as homes, having basements or cellars which extend below ground level, it is imperative that the ingress of water be prevented so that the basement space may remain usable. To that end, structures typically have footing drains leading to a sump or other similar collection basin, from which water is removed via a sump pump. It is a common practice in many areas of the United States to provide the sump in the floor of the basement.

A typical sump pump is an AC motor driven pump which operates using line power. Generally, a liquid level sensing device is provided to energize the pump motor when water level in the sump reaches a predetermined height and to deenergize the motor when the level has dropped to a safe level. Various types of sensing devices have been used for this purpose including sensors, float operated switches and pressure responsive switches.

The need for the sump pump is often greatest when storms occur. Unfortunately, the sump pump may not function when needed in an emergency because of a power failure or it may fail to operate because, for example, the level sensing device fails to operate. There are other factors that may result in the sump pump becoming inoperative, such as corrosion of certain pump parts, or clogging of the sump pump as a result of debris accumulating in the sump. In an attempt to solve the problems associated with the sump pump during those periods when pumping is necessary, a well-provided home also has a battery-operated emergency or backup pump, so that pumping can continue to avoid basement flooding.

Such battery or DC motor driven pumps are typically mounted in the sumps alongside the primary pumps, with the DC motor circuit being activated in response to a power line failure. Alarms have been provided for giving a warning if the battery voltage falls below a predetermined level. Unfortunately, these auxiliary DC systems have left much to be desired in preventing flooding due to AC motor driven pump failure. By way of example, since the battery operated pumps are rarely used, they sometimes are inoperative when their use is required. This may occur because the battery is incapable of supplying the power necessary to drive the pump. Although the static battery voltage may appear to be satisfactory, the initial current drain may reduce the battery voltage below the usable value.

Accordingly, the present disclosure provides a sump pump with an emergency backup system which overcomes certain difficulties with the prior art systems. The emergency backup system can be activated in response to power line failure, malfunctioning of the sump pump and/or the sump pump being overpowered by volume of water in the sump.

BRIEF DESCRIPTION

In accordance with one aspect of the present disclosure, a flood control system for use in a structure having a basement floor below ground level is provided. The flood control system comprises a sump, a main pump positioned in the sump, and a secondary pump positioned in the sum. The secondary pump is raised relative to the main pump to a predetermined elevation. The main pump is energized when a height of water within the sump is at a first level. The secondary pump is energized when a height of water within the sump reaches a second, higher level and is de-energized when a height of water within the sump drops to a third level. A cover is releasably mounted to the sump. The cover includes a first section for covering the main pump and a separate second section for covering the secondary pump. At least one of the first and second sections is hingedly mounted to the sump. A controller is operatively connected to the main pump and the secondary pump. The controller is responsive to water level within the sump to selectively energize at least one of the main pump and the secondary pump.

In accordance with another aspect of the present disclosure, a flood control system comprises a sump for gathering subterranean water for removal from the structure. An AC operated main pump and a DC operated secondary pump are positioned in the sump. An elevating member is located in the sump for raising a height of the secondary pump relative to the main pump. A cover is releasably mounted to the sump. The cover includes a first section for covering the main pump and a separate second section for covering the secondary pump. At least one of the first and second sections is hingedly mounted to the sump. A first discharge pipe is connected to an outlet of the main pump. A separate second discharge pipe is connected to an outlet of the secondary pump. The first and second discharge pipes extend through the cover and are configured to discharge to separate locations for preventing back pressure through the first and second discharge pipes.

In accordance with yet another aspect of the present disclosure, a flood control system comprises a sump, an AC operated main pump and a DC operated secondary pump. Each pump is positioned in the sump. The secondary pump is raised relative to said main pump to a predetermined elevation. The main pump is energized when a height of water within the sump is at a first level. The secondary pump being is energized when a height of water within the sump reaches a second, higher level and is de-energized when a height of water within the sump drops to a third level. A is shelf located in the sump for elevating the secondary pump in relation to the main pump. The shelf includes an opening configured to receive the main pump and a ring portion adjacent the opening for stopping a rotation of the shelf within the sump.

BRIEF DESCRIPTION OF THE DRAWINGS

FIG. 2 is a side elevational view of a shelf for elevating a secondary pump of the system of FIG. 1.

FIG. 3 is a top plan view of the shelf of FIG. 2.

FIG. 5 is a side elevational view of a cover for a sump of the system of FIG. 1.

FIG. 6 is a top plan view of the cover of FIG. 5.

DETAILED DESCRIPTION

Figure 4:
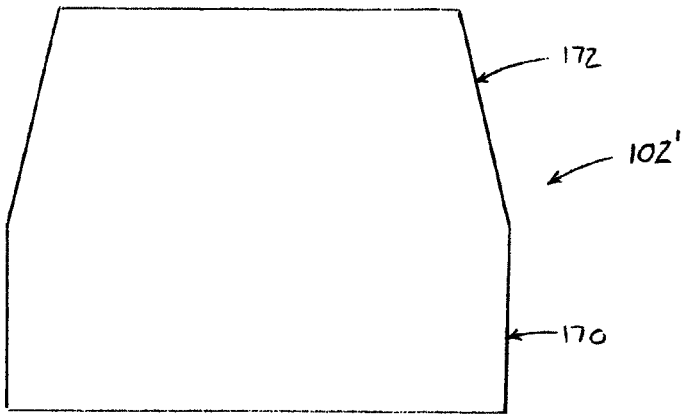
FIG. 4 is a side elevational view of a sump for the system of FIG. 1 according to another aspect of the present disclosure.

It should, of course, be understood that the description and drawings herein are merely illustrative and that various modifications and changes can be made in the structures disclosed without departing from the present disclosure. It will also be appreciated that the various identified components of the sump pump with an emergency backup system disclosed herein are merely terms of art that may vary from one manufacturer to another and should not be deemed to limit the present disclosure. All references to direction and position, unless otherwise indicated, refer to the orientation of the sump pump with an emergency backup system illustrated in the drawings and should not be construed as limiting the claims appended hereto.

Figure 1:
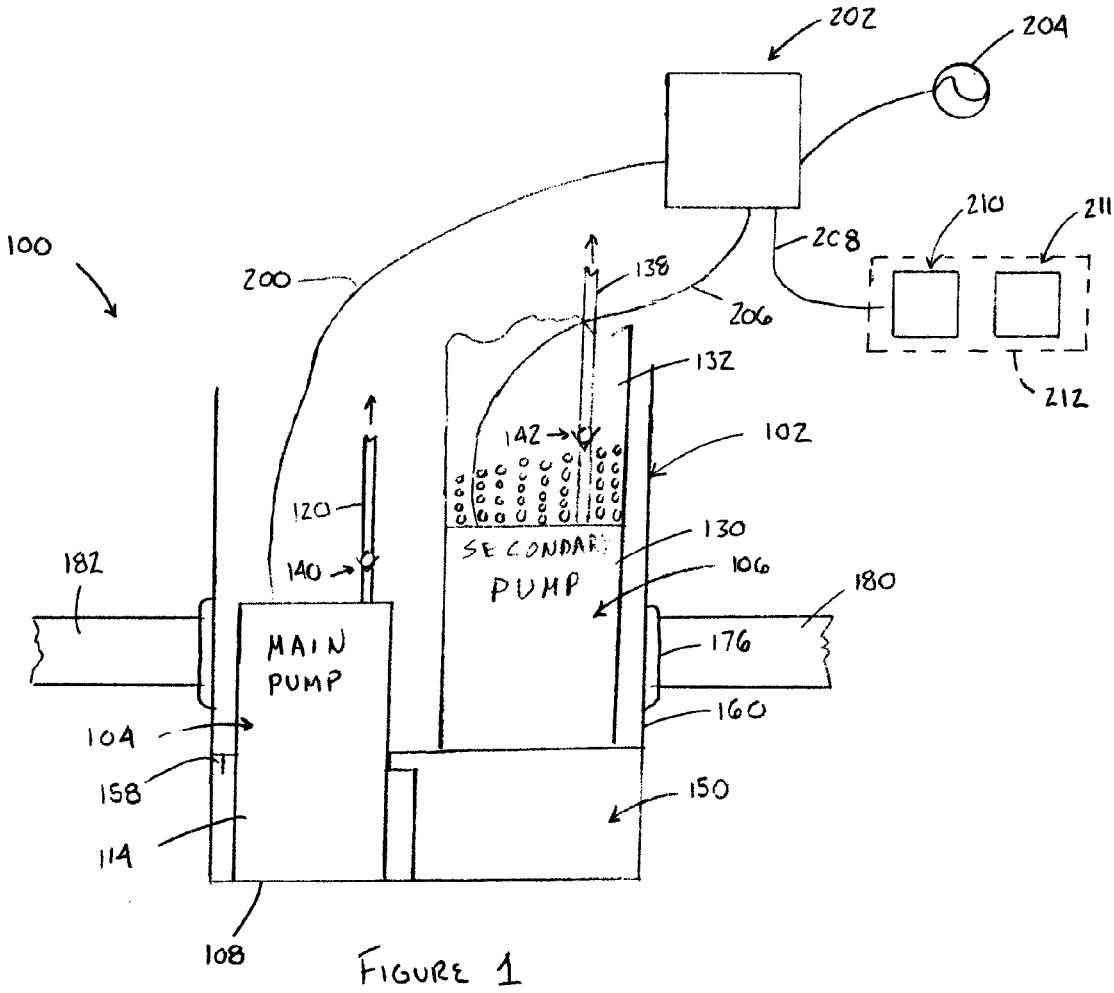
FIG. 1 is a schematic view of a sump pump with an emergency backup system according to the present disclosure.

Referring now to the drawings, wherein like numerals refer to like parts throughout the several views, FIG. 1 illustrates a sump pump with an emergency backup system 100 according to the present disclosure. The system 100 comprises a sump or crock 102 which houses a main or primary pump 104 and an emergency or secondary pump 106. The pumps 104 and 106 are of the submersible type wherein the respective motors are enclosed in hermetically sealed housings; although, this is not required.

The main pump 104, which can be located on a floor 108 of the sump 102, is an AC motor driven pump employed in the sump to remove liquid, e.g., subterranean water, which may collect therein. For example, the basements of homes or commercial establishments may have such sumps to collect subterranean water for removal and thereby keep the basement dry. The main pump includes a housing 114 within which is the AC motor (not shown). A bottom portion of the housing can include a mesh screen. A discharge pipe 120 is connected to an outlet of the main pump 104 and extends to an appropriate location for discharge.

A first liquid level sensing device (not shown) can be provided to energize the main pump motor when water level in the sump 102 reaches a predetermined height and to de-energize the motor when the water level has dropped to a safe level. The first liquid level sensing device can be conventional and include sensors, float operated switches, pressure responsive switches and the like.

As indicated in the Background, the main pump 104 is subject to failure. For example, because the main pump is powered by the same alternating current employed for electrical power elsewhere in the home or commercial establishment, if a power failure occurs, the main pump 104 becomes inoperative. Since it is not uncommon for such a power failure to occur as a result of a storm, the main pump 104 may become inoperative just at the very time it is needed most. It should be appreciated that there are other factors that may result in the main pump becoming inoperative, such as corrosion of certain pump parts, or clogging of the main pump as a result of debris accumulating in the sump 102. Because the main pump may occasionally fail to operate, the secondary pump 106 is employed to remove water collected within the sump 102.

The secondary pump 106 includes a housing 130 for housing, for example, a twenty-four (24) volt electric or DC driven motor (not shown). A filter, such as a perforated cylindrical sleeve 132, can be attached to an upper portion of the housing for filtering water that flows into the secondary pump. A second liquid level sensing device (not shown) for operating the DC motor can be mounted within the filter for protecting same against damage and against fouling by debris. Similar to the first liquid sensing device, the second liquid sensing device can be conventional and can energize the secondary pump 106 when water level in the sump 102 reaches a predetermined height and de-energize the secondary pump when the level has dropped to a safe level. A separate discharge pipe 138 is connected to an outlet of the secondary pump 106 and extends to an appropriate location for discharge.

It should be noted that the separate discharge pipes 120 and 138 ensure effective operation of the main and secondary pumps 104, 106. Particularly, when two separate pumps send water into discharge lines which are connected to form a single overall discharge line, as is common in the art, the system may not achieve optimum results. Conditions can occur whereby one pump can cancel out the other, or one pump can overpower the other pump, thereby preventing the other pump from operating at full capacity. This can be due to differing pumping capacities or by backpressure created by bends in the single discharge line. Therefore, in the present disclosure, the separate discharge pipes 120, 138 are configured to discharge to separate locations or into a larger diameter discharge pipe (having a diameter at least equal to the combined diameters of the two smaller discharge pipes running from the main and secondary pumps 104 and 106) located outside of the sump 102. The two smaller pipes 120 and 138 would connect at different locations on the larger pipe.

Figure 8:
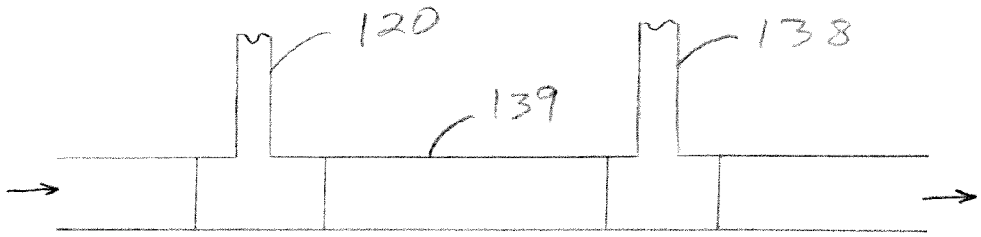
FIG. 8 is a schematic view of a conduit design which can be used according to the present disclosure.

In one embodiment, as illustrated in FIG. 8, the first discharge pipe 120 can have a diameter of 1½-2". The second discharge pipe 138 can also have a diameter of 1½-2". However, an underground line 139 into which they both discharge has a minimum diameter of 4". This size for the underground line assures that back pressure will not be caused through the first and second discharge pipes 120 and 138. It should also be noted that the first and second lines are connected to the underground line at different locations. As another alternative, the first and second discharge pipes are connected to completely separate lines (not shown). In this way, any possibility of the difficulties encountered by interconnected discharge pipes is avoided. For example, the first discharge line can connect to a downspout line and the second discharge line can connect to a city storm sewer line, or vice versa.

Further, check valves 140, 142 can be located at the outlets of the main and secondary pumps 104, 106, respectively, for connecting the outlets to the discharge pipes 120, 138. The check valves prevent backflow into the pumps.

As shown in FIG. 1, the secondary pump 106 can be located above the bottom surface 108 of the sump 102. The secondary pump 106 is generally not intended to operate all the time, but only in the event that the main pump 104 fails to keep the liquid level in the sump down to the lower part thereof. By raising the secondary pump off the bottom surface 108 to a predetermined elevation, the secondary pump can be configured to turn on when the liquid level in the sump 102 reaches a predetermined first level and turn off when the liquid level drops to a predetermined second level. This can eliminate the need for a control system tied to a liquid sensing device of the secondary pump 106. In the depicted embodiment, the secondary pump 106 is held on an elevating member or shelf 150 disposed in the sump or crock 102.

With reference to FIGS. 2 and 3 in one embodiment, the shelf 150 includes a horizontal surface or platform 152 and a vertically oriented mounting member or support 154 extending beneath a portion of the platform to space the platform away from the bottom surface 108 of the sump 102. The support can be one or more walls or legs connected to the platform. The shape of the platform is dependent on the configuration of the sump 102. An opening 156 extends through the platform, the perimeter of the opening being configured to receive the main pump 104. For example, as shown, the opening 156 can be generally circular to receive the generally cylindrical housing 114 of the main pump 104. A narrow ring portion 158 of the platform 152 is located on the far side of the opening 156. This serves as a means for stopping a rotation of the shelf within the sump 102. Once the shelf 150 is placed within the sump 102 and the main pump is securely located in the opening 156, the shelf is prevented from moving in the sump. The secondary pump 106 can then be positioned or mounted on the platform 152 alongside the main pump, but vertically spaced therefrom. The secondary pump can be mounted to the platform or to a wall 160 of the sump. It should be appreciated that alternative means for elevating the secondary pump 106 are contemplated. For example, a shelf can extend inwardly from the wall 160 of the sump, or the housing 140 of the secondary pump can be directly mounted to the sump wall via conventional fastening means.

To better accommodate both the main pump 104, the secondary pump 106 and the shelf 150, an alternative embodiment of a sump 102' is shown in FIG. 4. In this embodiment, the sump 102' can have a tapered configuration such that the sump is wider at a lower portion 170 compared to an upper portion 172. This allows the shelf to be positioned in the lower portion 170 without the need to secure the shelf in the sump. As shown in FIG. 1, the sump can have a wide band 176 located around its perimeter to allow drainage pipes 180, 182 to connect thereto.

With reference again to FIG. 1, a power line 200 connects the AC motor of the main pump 104 to a controller 202. The controller is connected to an AC power source 204, which provides power to the main pump. A similar power line 206 connects the 24 volt electric or DC motor of the secondary pump 106 to the controller. Thus, the controller is operatively connected to the main pump 104 and the secondary pump 106. The controller is responsive to water level within the sump to selectively energize the main pump and the secondary pump. Power line 208 connects the controller to a separate DC power source, such as a pair of separate 12 volt batteries 210 and 211. The batteries can be housed in a protective battery case 212. It should be appreciated that the two batteries 210 and 211 are connected in series so that 24 volt power is provided to the motor of the secondary pump 106. With this design, the secondary pump may be more powerful than the primary or main pump 104. Thus, if the main pump cannot keep up with the rising level of water in the sump 102 during a storm or the like, the secondary pump 106 will have the capacity to discharge a larger volume of water from the sump than the primary pump. Acting in combination, the two pumps can then keep up with the water flowing into the sump. But even if the main pump 104 fails, the secondary pump, due to its large pumping capacity can keep the sump from overflowing. In one embodiment, the capacity of the secondary pump can have a pumping capacity of about 2500 gallons per hour.

When the water level in the sump 102 rises to a first predetermined elevation and is sensed by the first liquid sensing device (not shown), the main pump 104 is energized via the controller 202 to pump water out of the sump through the discharge pipe 120. The main pump then remains energized for a predetermined time after the water level falls below the first elevation. If the main pump 104 fails to operate because of an interruption in AC power from the power line 200 via the AC power source 204 or because of a failure of the AC motor or another component of the main pump, or simply due to the volume of water in the sump 102, the water level in the sump will generally continue to rise. When the water level reaches a second predetermined elevation, the secondary pump 106 is activated. The secondary pump then remains energized for a predetermined time after the water level falls below the second predetermined elevation. Thus, the secondary pump 106 functions as a standby which can automatically set into operation to perform the pumping function normally performed by the main pump. If, on the other hand, the water level reaches the second elevation because the capacity of the main pump 104 is insufficient to handle the flow of water into the sump 102, then the two pumps can be operated simultaneously to prevent the water from over-flowing the sump.

As indicated above, it is only on infrequent occasions that the use of the secondary pump 106 will be required, but it is most important that the secondary pump function properly when its use is required. There are however, several reasons for failure of the secondary pump. For example, the motor of the secondary pump may be defective, the secondary pump itself may be defective or plugged or the DC power source (i.e., batteries 210, 211) may not provide sufficient power even though the voltage thereof during nonuse is at a satisfactory level. To prevent such failure, the controller 202 is configured to constantly monitor the output voltage of the DC power source. The controller can provide a warning if such voltage falls below a predetermined value. If the voltage falls, the controller can include means for charging the batteries from an AC power source, such as the AC power source 204 for the main pump or a separate AC power source. To further ensure the operation of the secondary pump 106 and sufficient output power of the batteries 210, 211, the controller 202 can switch to a test mode whereby the controller periodically activates the secondary pump for a set period of time. For example, the controller can cycle on the secondary pump 106 once a day for about eight (8) seconds. If the secondary pump functions properly, the controller returns the system 100 to normal operation. On the other hand, if the secondary pump fails to operate satisfactorily in the test mode, an alarm on the controller can be actuated to notify the user and the batteries 210, 211 can be recharged, if necessary. The disclosure herein is to a sump pump system which is simpler and more robust than the prior art. Also, less monitoring is necessary than in the known sump pump systems.

With reference to FIGS. 5 and 6, a removable cover or lid 220 for the sump 102 is illustrated. The cover is a two-piece cover and includes a first section 222 and a separate second section 224. Each section 222 and 224 includes a respective top surface 230 and 232 and a respective bottom surface 234 and 236. The first and second sections can be hingedly mounted to the sump 102 for easy access to the main and secondary pumps 104, 106. The first section includes a first flange 240 extending from the bottom surface 234. The second section includes a second flange 242 extending from the top surface. The flanges form an interface 248 between the first and second sections. The first section includes a pair of spaced apart cutouts 250 and 252. Similarly, the second section includes a pair of spaced apart cutouts 260 and 262. With the cover 220 in a closed position, cutouts 250 and 260 together form an opening for one of the discharge pipes 120, 138, and cutouts 252 and 262 together form an opening for the other of the discharge pipes. A separate opening 280 is located on the first section 222 for passage of the power lines 200, 206. An elongated opening 282 is located on the second section 224. The elongated opening allows a user to easily grasp and remove the cover 220.

While a particular sump design and lid design have been illustrated herein, it should be apparent to those of average skill in the art that the sump design and lid design can be changed while achieving the same objectives. It should also be appreciated that the sump pump with emergency backup system 100 can be a standalone system for removing subterranean water from a building or can be implemented into a home waterproofing system 300, schematically illustrated in FIG. 7. The home waterproofing system is described in greater detail in commonly owned U.S. Pat. No. 6,634,144, the disclosure of which is expressly incorporated herein by reference in its entirety.

The waterproofing system 300 is used with a foundation wall 310 which is supported on a footer 312. A first, outside trench 314 is excavated to a shallow depth beneath the ground level next to the outside surface of the wall. On the outside surface of the wall 310, a waterproofing sealing membrane 316 is affixed to seal the wall. A layer of gravel 320 is placed in a trough formed in the membrane. A drain tile 322 for draining water is placed in the trough and is at least partially covered by the gravel. The gravel protects the tile 322 from dirt and allows water to flow therethrough to the tile. The trench may be back filled with a backfill 326 of earth. A second, inside trench 328 is formed adjacent an inside surface of the wall 310 next to the footer 312. A gravel bed 330 is laid and drain tile 332 is placed in the inside trench 328. The drain tiles 332 are also covered with gravel 330. A third trench 350 can be formed on the outside of the wall 310 adjacent footer 312. A gravel bed 352 is laid and drain tile 354 is placed in the trench. The tile 354 is covered with gravel 352.

Figure 7:
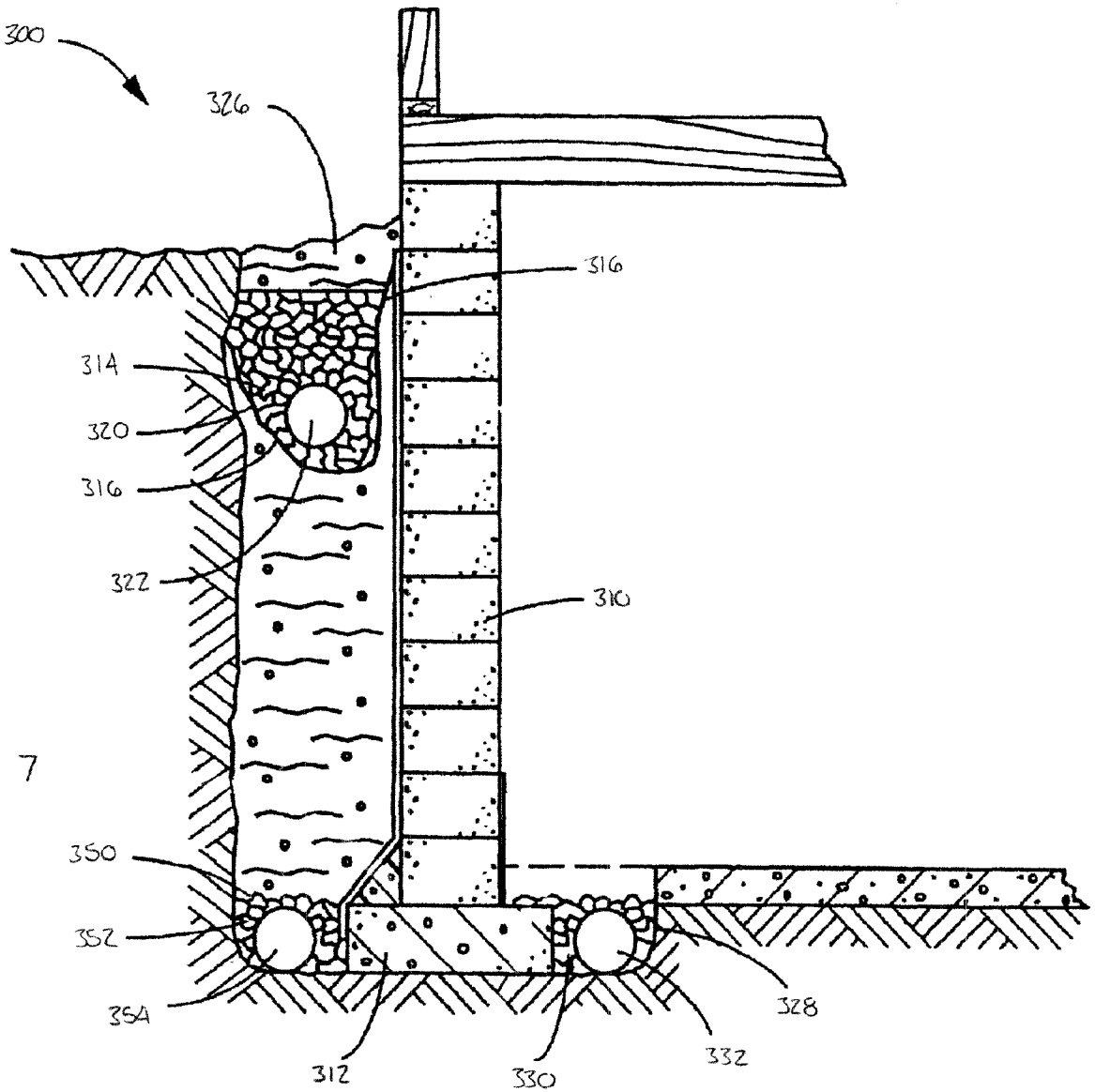
FIG. 7 is a schematic cross-sectional view of a building having a below-grade foundation wall with a waterproofing system for use with the system of FIG. 1.

The waterproofing system 300 of FIG. 7 operates as follows. Surface water outside the building flow into the first trench 314, the gravel 320, and through openings in the drain tile 322. This water flows through the drain tile into a storm sewer system. The tiles 322 located in the shallow trench outside the building provide for drainage of almost all surface water. Some water or moisture may form on the outside of the wall 310 and may flow down the wall. The membrane second portion 316 seals the wall and prevents the moisture from entering the wall. The water flows away from the wall toward the third trench 350 and the drain tile 354. Again, the water flows into the gravel and through openings in the drain tile. Additionally, a small amount of water may build up from beneath the building base. This water flows into the drain tile 332 located beneath the base in the second trench 328. This water flows through the drain tile and is pumped by the sump pump with emergency backup system 100 into the storm sewer system.

Figure 9:
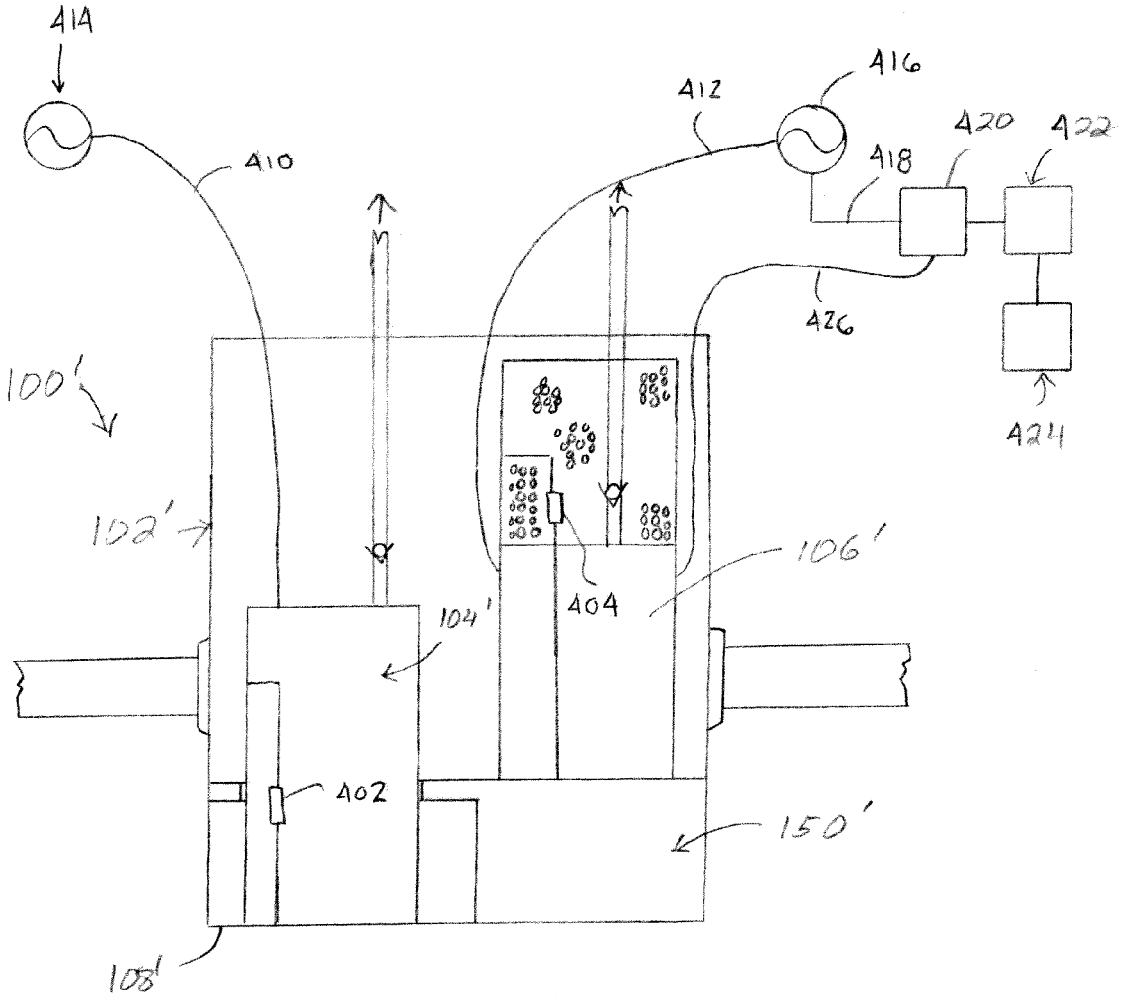
FIG. 9 is a schematic view of a sump pump with an emergency backup system according to another embodiment of the present disclosure.

With reference now to FIG. 9, another embodiment of the system is there illustrated. In this embodiment, like components are identified by like numerals with a primed (') suffix and new components are identified by new numerals. As in the embodiment of FIG. 1, there is provided a system 100' which comprises a sump or crock 102' which houses both a main or primary pump 104' and an emergency or secondary pump 106'. The main pump 104' can be located on a floor 108' of the sump 102'. In contrast, the secondary or emergency pump 106' is raised above the sump floor 108', since it is supported by a shelf 150'. In this embodiment, a sensor arrangement, such as liquid level sensors 402 and 404, is provided for the respective pumps 104' and 106'. The liquid level sensors are responsive to a height of water within the sump. Sensor 402 is configured to energize the main pump 104' when a height of water within the sump reaches a first level. Sensor 404 is configured to energize the secondary pump 106' when a height of water within the sump reaches a second, higher level. These water level sensors can be mounted directly to the respective pumps, if so desired.

Also, in this embodiment, separate power lines 410 and 412 are employed for the respective main pump 104' and secondary pump 106'. Power line 410 is connected to a first AC power source 414 and power line 412 is connected to a second AC power source 416. The second AC power source can also provide electricity via a third line 418 to a battery charger 420. The battery charger can selectively charge a DC power source, such as two 12 volt batteries 422 and 424. The DC power source can be employed to run the motor of the emergency secondary pump 106' via a line 426 when that becomes necessary. To this end, the battery charger 420 can also act to control the operation of the secondary pump via battery power. Thus, a simple, robust system is shown with a minimum of monitors or other complex electronics, which can be not only expensive but are subject to malfunctions.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art. These are also intended to be encompassed by the following claims, and their equivalents.

What is claimed is:

1. A flood control system for use in a structure having a basement floor below ground level, the system comprising:

a sump;

a main pump positioned in said sump, said main pump being energized when a height of water within said sump is at a first level;

a secondary pump positioned in said sump, said secondary pump being raised relative to said main pump to a predetermined elevation, said secondary pump being energized when a height of water within said sump reaches a second, higher level and de-energized when a height of water within said sump drops to a third level;

a cover releasably mounted to said sump, said cover including a first section for covering said main pump and a separate second section for covering said secondary pump, at least one of said first and second sections being hingedly mounted to said sump; and a controller operatively connected to said main pump and said secondary pump, said controller being responsive to water level within said sump to selectively energize at least one of said main pump and said secondary pump.

2. The system of claim 1, further including:

a first level sensor operatively connected to said main pump and responsive to the level of liquid in said sump, said first level sensor being in communication with the controller for energizing said main pump when a height of water within said sump reaches said first level; and a second level sensor operatively connected to said secondary pump and responsive to the level of liquid in said sump, said second level sensor being in communication with said controller for energizing said secondary pump when a height of water within said sump reaches said second, higher level.

3. The system of claim 1, further including a first discharge pipe connected to an outlet of said main pump and a separate second discharge pipe connected to an outlet of said secondary pump, wherein said first and second discharge pipes are configured to discharge to separate locations.

4. The system of claim 3, wherein the first and second discharge pipes are connected to a third discharge pipe having a diameter substantially equal to the combined diameters of said first and second discharge pipes, wherein the diameter of said third discharge pipe is large enough to substantially prevent back pressure through said first and second discharge pipes.

5. The system of claim 3, wherein said first section of said cover includes a pair of spaced apart first cutouts and said second section of said cover includes a pair of spaced apart second cutouts, wherein said first cutouts and said second cutouts together form first and second openings dimensioned to receive said first and second discharge pipes.

6. The system of claim 1, wherein said secondary pump discharges a larger volume of water during a selected time period from said sump than said main pump.

7. The system of claim 1, wherein said controller is configured to intermittently test operation of said secondary pump by periodically activating said secondary pump for a set period of time.

8. The system of claim 7, further including a DC power source electrically connected to said secondary pump, wherein said controller is configured to monitor output voltage of said DC power source, wherein said controller includes means for charging said DC power source from an AC power source if voltage of said DC power source falls below a predetermined value.

9. The system of claim 8, wherein said DC power source includes a pair of 12 volt batteries connected in series, said batteries providing 24 volts to said secondary pump.

10. The system of claim 1, further including a shelf spaced from a bottom portion of said sump for raising said secondary pump relative to said main pump.

11. The system of claim 10, wherein said shelf includes an opening configured to receive said main pump and a ring portion for stopping a rotation of said shelf within said sump.

12. The system of claim 1, wherein said sump has a tapered configuration.

13. A water control system for use in a structure having a basement floor below ground level, the system comprising:

a sump for gathering subterranean water for removal from the structure;

a main pump positioned in said sump;

a secondary pump positioned in said sump;

an elevating member located in said sump for raising a height of said secondary pump relative to said main pump;

a cover mounted to said sump, said cover including a first section for partially covering the sump and a separate second section selectively engaging the first section, such that when engaged the first and separate second section completely cover the sump; and a first discharge pipe connected to an outlet of said main pump and a separate second discharge pipe connected to an outlet of said secondary pump, said first and second discharge pipes extend through said cover along an engagement of the first section and the separate second section and are configured to discharge to separate locations for preventing back pressure through said first and second discharge pipes.

14. The system of claim 13, including a controller operatively connected to said main pump and said secondary pump for selectively activating said main pump and said secondary pump singly or in combination, said controller being configured to intermittently test operation of said secondary pump.

15. The system of claim 13, wherein said elevating member includes a shelf spaced from a floor of said sump.

16. The system of claim 13, wherein said first section of said cover includes a pair of spaced apart first cutouts and said second section of said cover includes a pair of spaced apart second cutouts, wherein said first cutouts and said second cutouts together form first and second openings dimensioned to receive said first and second discharge pipes.

17. A pump system for use in a structure having a portion below ground level, the system comprising:

a sump;

a main pump positioned in said sump, said main pump being energized when a height of water within said sump is at a first level;

a secondary pump positioned in said sump, said secondary pump being raised relative to said main pump to a predetermined elevation, said secondary pump being energized when a height of water within said sump reaches a second, higher level and de-energized when a height of water within said sump drops to a third level;

a shelf located in said sump for elevating said secondary pump in relation to said main pump, said shelf including an opening configured to receive said main pump and a ring portion adjacent said opening for stopping a rotation of said shelf within said sump; and a cover including a first section and a separate second section, said first and second sections being hingedly mounted to said sump for easy access to said main and secondary pumps.

18. The system of claim 17, further including a first discharge pipe connected to an outlet of said main pump and a separate second discharge pipe connected to an outlet of said secondary pump, wherein said first and second discharge pipes are connected to a third discharge pipe at separate locations, said third discharge pipe having a diameter substantially equal to the combined diameters of said first and second discharge pipes.

19. The system of claim 17, wherein said the sump has a tapered configuration allowing said shelf to be positioned in said sump without the need to secure said shelf in said sump.

* * * * *